US005494062A

United States Patent [19]

Springer

[11] Patent Number: 5,494,062

[45] Date of Patent: Feb. 27, 1996

[54] ELECTROMECHANICAL CONTROLLER FOR DISHWASHER WITH ALTERNATING FLOW

[75] Inventor: Phillip J. Springer, Kinston, N.C.

[73] Assignee: White Consolidated Industries, Inc., Cleveland, Ohio

[21] Appl. No.: 383,055

[22] Filed: Feb. 3, 1995

[51] Int. Cl.[6] ..... A47L 15/14

[52] U.S. Cl. ..... 134/58 D; 134/178; 134/191; 134/199; 137/119; 239/443

[58] Field of Search ..... 134/57 D, 58 D, 134/178, 191, 199; 239/443, 444, 99; 137/119

[56] References Cited

U.S. PATENT DOCUMENTS

| | | | |
|---|---|---|---|
| 2,771,894 | 11/1956 | Low | 134/57 D |
| 2,825,665 | 3/1958 | Stoddard | 134/25.2 |
| 3,160,164 | 12/1964 | Constance et al. | 137/119 X |
| 3,199,525 | 8/1965 | Jellies | 134/57 D X |
| 3,439,687 | 4/1969 | Cushing | 134/57 D |
| 3,440,399 | 4/1969 | Reifenberg | 134/57 D X |
| 3,835,880 | 9/1974 | Hoffman et al. | 134/57 D X |
| 4,159,211 | 6/1979 | Hoffman et al. | 134/57 D |
| 4,525,608 | 6/1985 | Cushing . | |
| 4,559,959 | 12/1985 | Meyers | 134/56 D |
| 4,741,353 | 5/1988 | Milocco | 137/119 |
| 5,264,043 | 11/1993 | Milocco | 134/25.2 |

*Primary Examiner*—Philip R. Coe

*Attorney, Agent, or Firm*—Pearne, Gordon, McCoy & Granger

[57] ABSTRACT

A dishwasher is provided with a valve for alternating flow to upper and lower spray arms during washing. The valve is controlled by periodic interruption of the pump for certain lengths of time. An electromechanical timer has a main cam wheel and an auxiliary cam wheel. The main cam wheel controls the pump and other parts of the dishwasher. The auxiliary cam wheel overrides the main cam wheel control of the dishwasher to provide the periodic lobes.

12 Claims, 3 Drawing Sheets

ELECTROMECHANICAL CONTROLLER FOR DISHWASHER WITH ALTERNATING FLOW

BACKGROUND OF THE INVENTION

1. Field of the Invention

This invention relates generally to the field of dishwashers and specifically to a controller for a dishwasher having alternating liquid flow to spray arms.

2. Description of the Related Art

Washing machines, particularly dishwashers, often have two or more spray arms for directing washing liquid at objects to be washed. Typically, a lower spray arm is located near the bottom of a wash tub and an upper spray arm is located in a middle area or near the top of the wash tub. A pump is provided to deliver liquid from a sump in the bottom of the tub to the spray arms. Commonly, the liquid is delivered simultaneously to both spray arms in more or less equal amounts.

U.S. Pat. Nos. 4,741,353 and 5,264,043, both to Milocco and incorporated herein by reference, show and describe an apparatus and method for alternating liquid flow between the spray arms. A specialized ball valve switches flow from one arm to the other when operation of the pump is interrupted for a certain amount of time. The Milocco references show a programmed electronic controller for operating the pump to achieve proper operation of the valve. It would be desirable to use an electromechanical controller for such an apparatus because of the inherent simplicity and reliability.

Electromechanical controllers for dishwashers are well known, as shown, for example, in U.S. Pat. Nos. 2,771,894; 2,825,665; 3,199,525; 3,439,687; 3,440,399; 3,835,880; 4,159,211; 4,559,959 all incorporated herein by reference. Typically these controllers have a cam wheel defining a plurality of coaxial cam disks each adapted to operate one or more switches. The switches are connected to control different machine functions. The cam wheel is driven by a timer motor. In some installations, the controller is provided with an auxiliary cam wheel to control a specific function of the washer. For example, the auxiliary cam can be connected to control a water valve to provide a brief (about 11 seconds) inlet of water to purge the sump of dirty water at the end of a washing operation. Such controllers are simple, reliable, and adequate for most dishwashing functions. Therefore, it is desirable to adapt an electromechanical timer to control the short and precise lobes required for the Milocco ball valve.

SUMMARY OF THE INVENTION

The present invention provides washer with two sprayers for spraying fluid and a pump for delivering fluid to the sprayers. A valve controls flow from the pump to the sprayers to alternate fluid flow between the sprayers. A controller is adapted for stopping and starting the pump thereby controlling the valve to alternate flow of fluid to the sprayers. The controller includes a switch connected to energize the pump and a first timer wheel adapted to operate the switch so as to energize the pump for a certain period of time. A second timer wheel is adapted to override the first timer wheel to operate the switch to deenergize the pump for a certain period of time.

Preferably, the valve comprises a ball adapted to block one of two conduits in communication with respective sprayers. The valve is adapted to move the ball from one conduit to the other when water flow to the valve is interrupted. A second switch is connected in parallel with the first switch and adapted to operate the pump regardless of the state of the first switch. The controller also includes a timer motor adapted to rotate the timer wheels. The timer wheels are rotatable cam wheels and a cam follower mounted on the switch is operated by the first timer wheel. A lever is operated by the second timer wheel and disposed to open the switch. An appendage mounted on the switch is operated by the lever. The switch comprises a pair of spring arms having electrical contacts adapted to close a circuit. Thus, the invention provides a simple and reliable washer adapted to alternately spray water from upper and lower spray arms.

DESCRIPTION OF THE PREFERRED EMBODIMENTS

Figure 1:
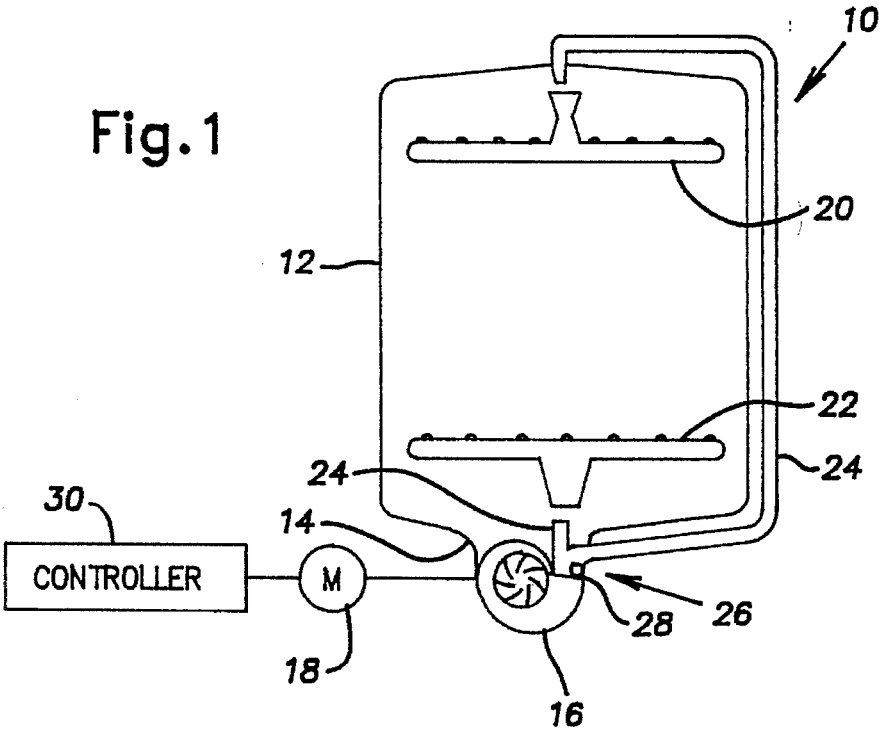
FIG. 1 shows a schematic front elevation of a dishwasher according to the invention.

Referring to FIG. 1, a washer, such as a dishwasher 10, includes a wash tub 12 for containing objects to be washed. A lower part of the tub 12 defines a sump 14 for collecting washing liquid, such as a solution of water and detergent. A pump 16 driven by a motor 18 is located in communication with the sump 14. The pump 16 is adapted for delivering liquid to an upper spray arm 20 and a lower spray arm 22 through suitable conduits 24. The spray arms 20, 22 spray liquid on the objects in the tub 12. A valve 26 is disposed between an outlet of the pump and the conduits 24. The valve 26 includes a ball 28 for alternately blocking each of the conduits 24 to limit liquid flow to one of the spray arms 20, 22 at a time. Such a valve is described in detail in U.S. Pat. No. 4,741,353 to Milocco. Interruption of a flow of liquid from the pump 16 through the valve 26 causes the ball 28 to change position from blocking one conduit to blocking the other conduit. When flow resumes, liquid is delivered to the other spray arm. Thus, as described below, proper control of liquid flow from the pump 16 causes alternating flow from the spray arms 20, 22. A controller 30 is connected to the pump motor 18 to achieve the desired liquid flow.

Figure 2:
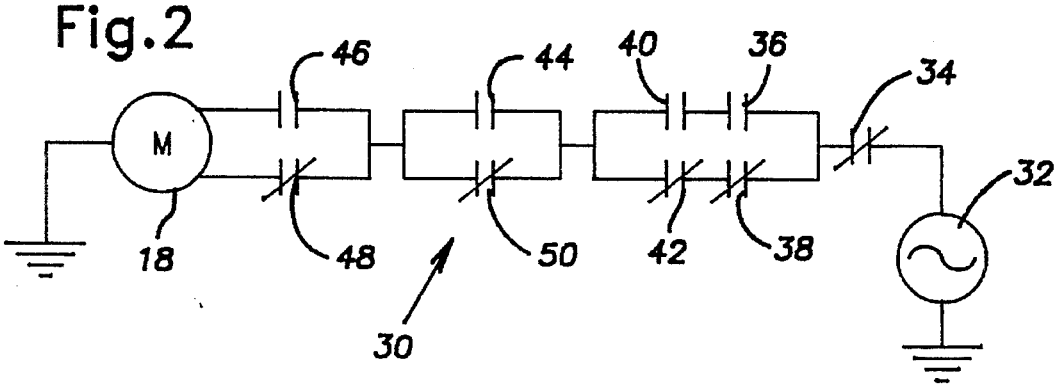
FIG. 2 shows a schematic diagram of an electrical circuit according to the invention.

Referring to FIG. 2, the controller 30 is connected between the pump motor 18 and a power source 32 such as a household alternating current supply. The controller 30 includes a door switch 34 that is normally closed when a door closing the tub 12 is closed and locked. A rinse cycle selector switch 36 and a wash cycle selector switch 38 are connected in parallel with each other and in series with the door switch 34. The rinse cycle selector switch 36 is closed for a "rinse & hold" and a "pots & pans" washing operation. The wash cycle selector switch 38 is closed for a "normal wash" and the "pots & pans" washing operation. A first bus switch 40 and a second bus switch 42 are connected in series with respective cycle selector switches 36, 38. The bus switches 40, 42 are normally open. The first bus switch 40 is closed during a pre-rinse period and the second bus switch 42 is closed during the remaining period of operation. Other combinations of cycle switches and bus switches for controlling other cycles are also suitable and well known in the art.

A motor switch 44 is connected in series with the bus switches 40, 42. The motor switch 44 is normally closed and is opened to deenergize the motor and also during interrupted operation of the motor to achieve alternating flow of liquid to the spray arms 20, 22, as discussed below. A drain switch 46 is connected in series with the motor switch 44. The drain switch 46 is normally closed and operates the pump motor 18 during a drain phase. The drain switch 46 is opened during phases other than draining. A wash switch 48 is connected in series with the motor switch 44 and in parallel with the drain switch 46. The wash switch 48 is normally closed and operates the pump motor 18 during washing and rinsing operations. Unless stated otherwise, it is assumed that the wash cycle switch 38, second bus switch 42, and wash switch 48 are closed during operations discussed below. A motor interval switch 50, is connected in parallel with the motor switch 44. The motor interval switch 50 is normally closed, but is held open during all operations except during interrupted operation of the motor 18. The following description relates primarily to the operation of the motor interval switch 50 and corresponding operation of the pump 16 during a washing operation during which flow alternates between the spray arms 20, 22. The combinations and connections of other switches can vary. FIG. 2 shows the status of the other switches during such a washing operation.

Figure 3:
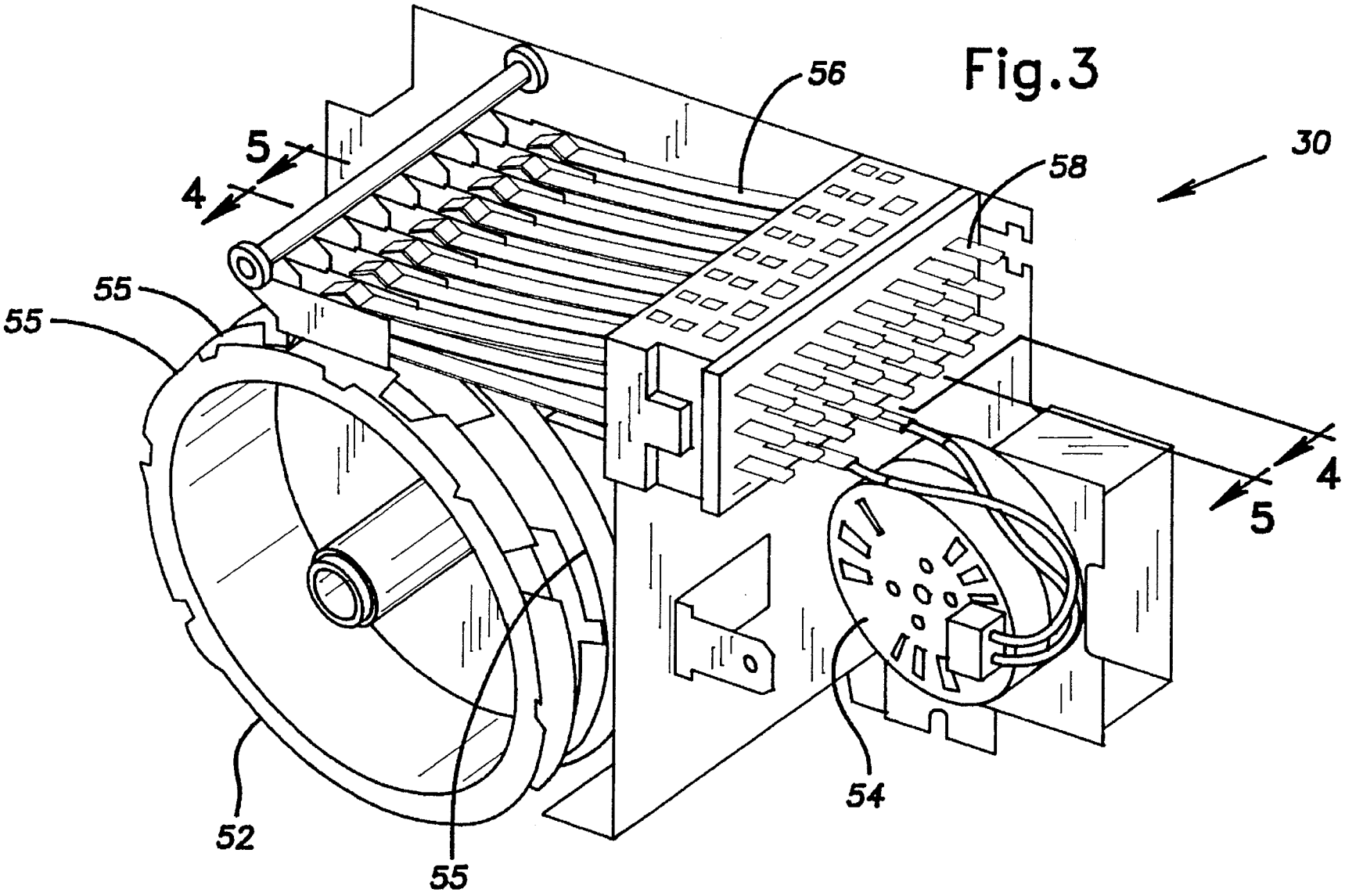
FIG. 3 shows a rear isometric view of a controller according to the invention.

Referring to FIG. 3, the controller 30 includes a cam wheel 52 driven by a timer motor 54. The cam wheel defines a plurality of coaxial cam disks 55. Plural spring arms 56 are located above the cam wheel 52 and electrically connected to connection lugs 58. The lugs are adapted to be connected to electrical circuits of the dishwasher 10.

Figure 4:
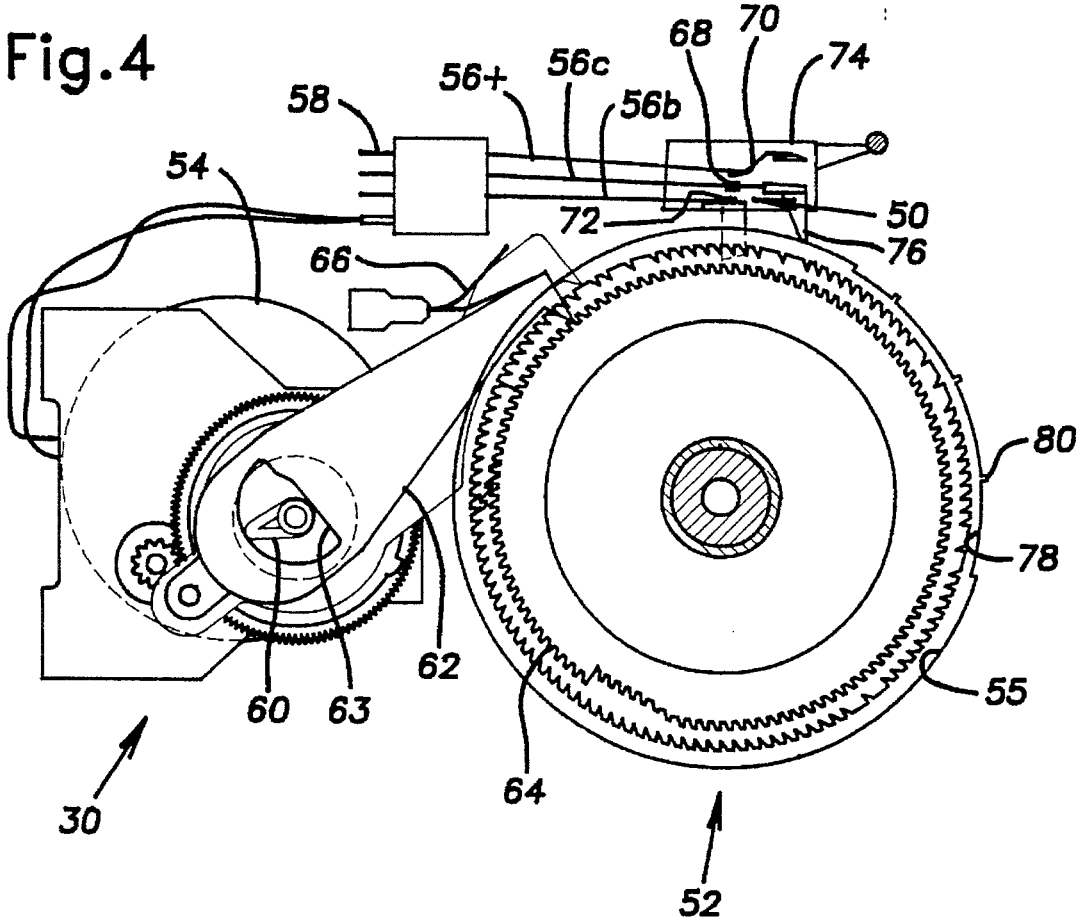
FIG. 4 shows a front elevation of the controller in a section taken from line 4—4 of FIG. 3.

Referring to FIG. 4, the timer motor 54 rotates an eccentric cam 60 on an axis to oscillate a finger 62 having an eccentric opening 63. The finger 62 engages teeth 64 on the cam wheel 52 to drive the cam wheel stepwise about an axis of the cam wheel 52. The finger 62 is biased toward the teeth 64 by a spring 66.

The spring arms 56 are arranged in sets of three, each set including a top arm **56*t*, a center arm 56*c*, and a bottom arm 56*b*. The center arm 56*c* is provided with a pair of electrical contacts 68 adapted to create an electrically conducting path with a contact 70 on the top arm 56*t* or a contact 72 on the bottom arm 56*b*. The bottom arm 56*b* is biased to normally close its contact 72 with the bottom contact 68 of the center arm 56*c*. In a conventional manner, contacts 68, 70, 72 on different sets of spring arms 56 are used as the switches 40, 42, 44, 46, 48 discussed above. Preferably contacts 68, 72 on the bottom arm 56*b* and center arm 56*c* nearest the front of the controller 30 are used as the motor interval switch 50, for reasons discussed below. A contact spacer 74 positions the top and bottom arms 56*t*, 56*b* to maintain a proper air gap between the contacts 68, 70, 72. A cam follower 76 is provided at an end of the center arm 56*c*. The cam disk 55 nearest the front of the controller 30 corresponds with the spring arms 56 nearest the front. The cam disk 55 engages the cam follower 76 to maintain the center arm 56*c* in a neutral position wherein the contacts 68, 70, 72 are open, as shown in FIG. 4. A tooth (not shown) on the cam disk 55 will raise the center arm 56*c* to close the center contact 68 with the top contact 70. This is not utilized in the embodiment shown for the spring arms 56 nearest the front. A gap 78 in the cam disk 55 permits the center arm 56*c* to lower and close with the bottom contact 72, thereby closing the wash interval switch 50. The front cam disk 55 is arranged with plural gaps 78. The gaps 78 are separated by lobes 80 that raise the center arm 56*c* and open the wash interval switch 50 to deenergize the pump motor 18. As the cam wheel 52 rotates, gaps 78 and lobes 80 on the cam disk 55 open and close the contacts 68, 72 to control operation of the pump motor 18 and pump 16**. Similarly, other dishwasher functions are controlled by other contacts operated by gaps, lobes, and teeth of other cam disks.

Figure 6:
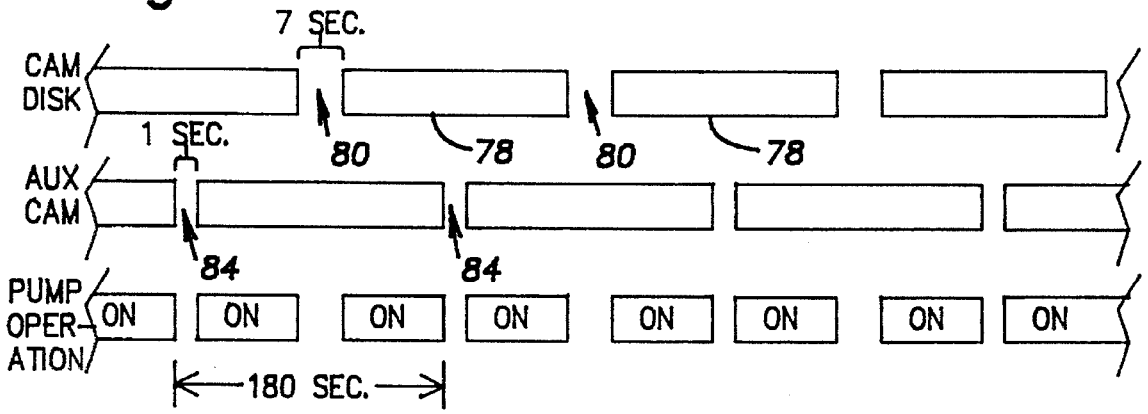
FIG. 6 shows a timing diagram for operation of selected switches and a pump of the dishwasher.

Referring to FIG. 6, a first timing diagram shows the spacing of gaps 78 and lobes 80 and the corresponding operation of the pump 16. According to a preferred construction of the invention, the lobes 80 are spaced at approximately 180 second intervals and open the wash interval switch 50 (FIG. 2) for 7±3 seconds.

Figure 5:
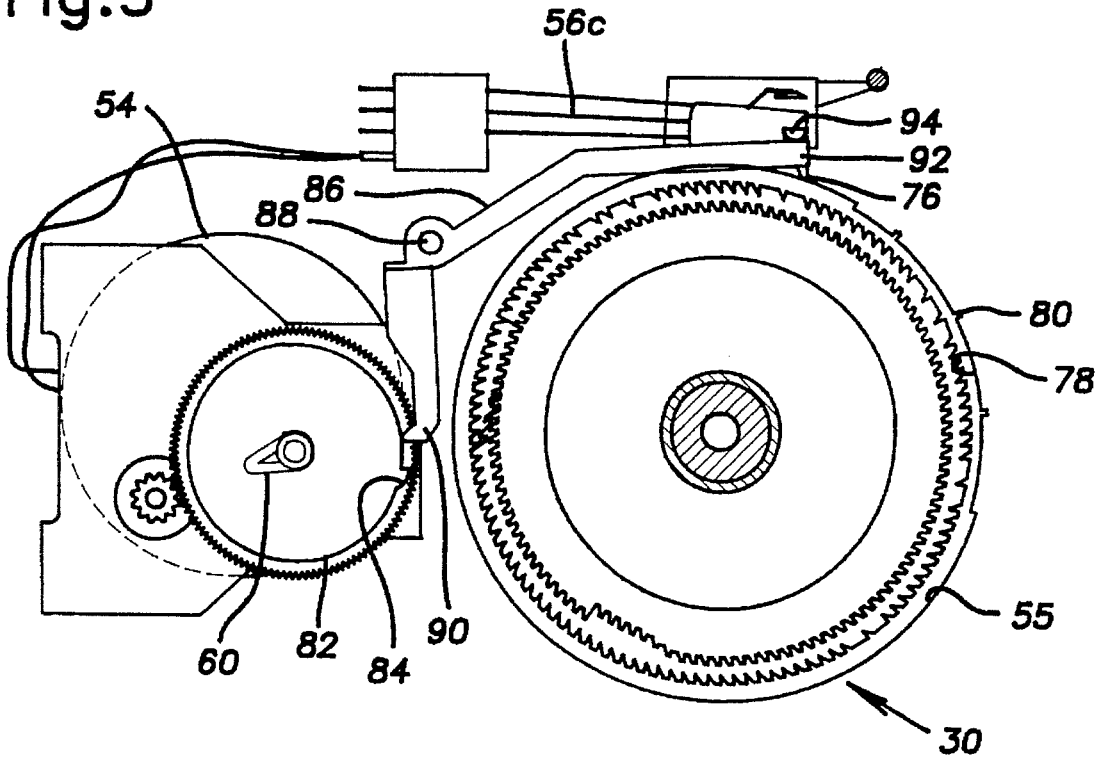
FIG. 5 shows a front elevation of the controller in a section taken from line 5—5 of FIG. 3.

Referring to FIG. 5, the timer motor 54 drives an auxiliary cam wheel 82 that is preferably concentric with the eccentric cam 60. The auxiliary cam wheel 82 has a generally smooth surface with a single lobe 84. The auxiliary cam wheel 82 is sized to rotate once in approximately 180 seconds, corresponding with the period of the gaps 78 on the cam disk 55. A lever 86 mounted on a pivot 88 has a cam follower 90 that engages the auxiliary cam wheel 82. An end 92 of the lever 86 opposite the cam follower 90 is positioned to operate an appendage 94 extending from the cam follower 76 of the center arm **56*c*. When the tooth 84 operates the lever 86, the center arm 56*c* is lifted to open the switch 50 (FIG. 2). The auxiliary cam wheel 82, thus, overrides the cam disk 55 to deenergize the pump motor 18 regardless of the cam disk 55** position.

Referring again to FIG. 6, the lobe 84 opens the switch for 1±0.5 second about every 180 seconds. The lobe 84 is positioned to open the wash interval switch 50 about midway between the lobes 80 on the cam disk 55. Therefore, as shown in the bottom timing diagram, during a 180 second cycle of pump 16 operation, the pump will stop twice, once for 1 second and once for 7 seconds. The stopping of the pump 16 permits the ball 28 of the valve 26 to change positions. When the pump starts again, liquid flows to the opposite spray arm, thereby alternating the flow of wash liquid to the spray arms 20, 22.

According to another embodiment of the invention (not shown), the auxiliary cam wheel can operate another switch separate from the motor interval switch 50. The other switch would be connected in series with the motor interval switch 50. Thus, the motor interval switch would not need to be nearest the front of the controller.

According to operation of a preferred embodiment, the wash switch 44 is closed during rinsing and draining operations to operate the pump 16 continuously. During washing operations, the wash switch 44 is open and the wash interval switch 50 is operated as discussed above. At the beginning of a wash operation, the cam disk 55 closes the switch 50 to energize the pump motor 18 and pump 16. Liquid flows through the valve 26 to the lower spray arm 22. Flow to the upper spray arm 20 is blocked by the ball 28. After about 60 seconds, the auxiliary cam 82 opens the wash interval switch 50 to deenergize the pump motor 18 and pump 16 for about 1 second. The ball 28 changes positions, the switch 50 closes again, and liquid flows to the upper spray arm 20. Operation continues for about 60 seconds until the cam disk 55 opens the motor interval switch 50 for 7 seconds. Water flows out of the conduit 24 and the ball 28 again switches positions.

The motor interval switch 50 closes and water flow to the lower spray arm 22 resumes. Operation continues with alternating flow to the spray arms 20, 22 until the wash operation is completed. At the end of the wash operation, the cam disk 55 opens the motor interval switch 50 for the remainder of the dishwasher operation. Subsequent operation of the pump is controlled by the motor switch 44, drain switch 46 and wash switch 48.

The present disclosure describes several embodiments of the invention, however, the invention is not limited to these embodiments. Other variations are contemplated to be within the spirit and scope of the invention and appended claims.

What is claimed is:

1. A washer, comprising:

two sprayers for spraying fluid;

a pump for delivering fluid to the sprayers;

a valve for controlling flow from the pump to the sprayers so as to alternate fluid flow between the sprayers;

a controller adapted for stopping and starting the pump thereby controlling the valve to alternate flow of fluid to the sprayers, said controller comprising:

a switch connected to energize the pump;

a first timer wheel adapted to operate the switch so as to energize the pump for a certain period of time; and a second timer wheel adapted to override the first timer wheel to operate the switch to deenergize the pump for a certain period of time.

2. A washer according to claim 1, further comprising two conduits in communication between the pump and respective sprayers wherein the valve comprises a ball adapted to block one of the two, said valve being adapted to move the ball from one conduit to the other when water flow to the valve is interrupted.

3. A washer according to claim 1, further comprising a second switch connected in parallel with the first switch and adapted to operate the pump regardless of the state of the first switch.

4. A washer according to claim 1, wherein the controller comprises a timer motor adapted to rotate the timer wheels.

5. A washer according to claim 1, wherein the timer wheels are rotatable cam wheels.

6. A washer according to claim 5, further comprising a cam follower mounted on the switch and operated by the first timer wheel.

7. A washer according to claim 5, further comprising a lever operated by the second timer wheel and disposed to open the switch.

8. A washer according to claim 7, further comprising an appendage mounted on the switch and operated by the lever.

9. A washer according to claim 1, wherein the switch comprises a pair of spring arms having electrical contacts adapted to close a circuit.

10. A washer, comprising:

a wash tub having a sump in a lower part thereof;

two sprayers for spraying washing liquid on objects in the tub;

a pump for delivering liquid from the sump to the sprayers;

a valve arranged for controlling flow from the pump to the sprayers so that lobes in liquid flow from the pump cause the valve to alternate liquid flow between the spray arms;

a controller adapted for energizing and deenergizing the pump thereby controlling the valve to alternate flow of liquid to the sprayers, said controller comprising:

a switch including a first arm having a first electrical contact and a cam follower, and a second arm having a second electrical contact, said switch being connected to energize the pump when the contacts are engaged to close the switch;

a first timer wheel adapted for rotation and having a plurality of gaps and lobes adapted operate the cam follower to close and open the switch so as to energize and deenergize the pump for certain periods of time; and a second timer wheel adapted for rotation and having a lobe adapted to operate the switch to override the first timer wheel to open the switch to deenergize the pump for a certain period of time.

11. A washer according to claim 10, further comprising a lever operated by the second timer wheel and adapted to operate the switch.

12. A washer, comprising:

a wash tub having a sump in a lower part thereof;

upper and lower spray arms for spraying washing liquid on objects in the tub;

a pump for delivering liquid from the sump to the spray arms;

two conduits in communication between the pump and respective spray arms;

a valve arranged for controlling flow from the pump to the spray arms so that lobes in liquid flow from the pump cause the valve to alternate liquid flow between the spray arms, said valve comprising a ball adapted to block one of the two conduits, said valve being adapted to move the ball from one conduit to the other when water flow to the valve is interrupted;

a controller adapted for operating and interrupting operation of the pump thereby controlling the valve to alternate flow of liquid to the sprayers, said controller comprising:

a switch including a first arm having a first electrical contact, a cam follower, and an appendage, and a second arm having a second electrical contact, said switch being connected to energize the pump when the contacts are engaged to close the switch;

a first cam wheel adapted for rotation on a first axis and having a plurality of gaps and lobes adapted operate the cam follower to close and open the switch so as to energize and deenergize the pump for certain periods of time;

a lever having an end adapted to operate the appendage; and a second cam wheel adapted for rotation on a second axis and having a lobe adapted to operate the lever to override the first cam wheel to open the switch to deenergize the pump for a certain period of time.

* * * * *